US012097943B1

(12) United States Patent
Pelini

(10) Patent No.: US 12,097,943 B1
(45) Date of Patent: Sep. 24, 2024

(54) MULTI-ENGINE, SINGLE MOUNT, HYDRAULIC JACK PLATE WITH ADJUSTABLE TENSIONING RODS

(71) Applicant: Mark Pelini, Valrico, FL (US)

(72) Inventor: Mark Pelini, Valrico, FL (US)

( * ) Notice: Subject to any disclaimer, the term of this patent is extended or adjusted under 35 U.S.C. 154(b) by 524 days.

(21) Appl. No.: 17/568,069

(22) Filed: Jan. 4, 2022

(51) Int. Cl.
*B63H 20/10* (2006.01)
*B63H 20/06* (2006.01)

(52) U.S. Cl.
CPC ..... *B63H 20/10* (2013.01); *B63H 20/06* (2013.01)

(58) Field of Classification Search
CPC ..... B63H 20/10; B63H 20/06
See application file for complete search history.

(56) References Cited

U.S. PATENT DOCUMENTS 4,624,438 A * 11/1986 Goodman, Jr. ..... B63H 20/106 248/642
5,782,662 A * 7/1998 Icenogle ..... B63H 20/106 248/641
7,416,459 B1 8/2008 Pelini
7,731,552 B1 6/2010 Pelini
8,535,105 B1 9/2013 Pelini
8,657,637 B1 2/2014 Pelini
8,882,551 B1 * 11/2014 Quail ..... B63H 20/06 440/53
10,293,905 B1 5/2019 Pelini
10,293,906 B1 5/2019 Pelini

* cited by examiner

*Primary Examiner* — Stephen P Avila
(74) *Attorney, Agent, or Firm* — Edward P Dutkiewicz

(57) ABSTRACT

The pair of transom mounting brackets are movably coupled to a pair of tensioning rods, which allows the adjustment of the transom mounting brackets. There is a lower cross brace and a pair of upper cross braces. A slide plate is slidably coupled to the transom mounting brackets. A pair of hydraulic cylinders are coupled to the lower cross brace and each of the hydraulic cylinders is operatively coupled to the slide plate. A pair of motor mounting plate offsets are coupled to the slide plate and to a multi-engine mounting plate.

10 Claims, 8 Drawing Sheets

FIG. 7
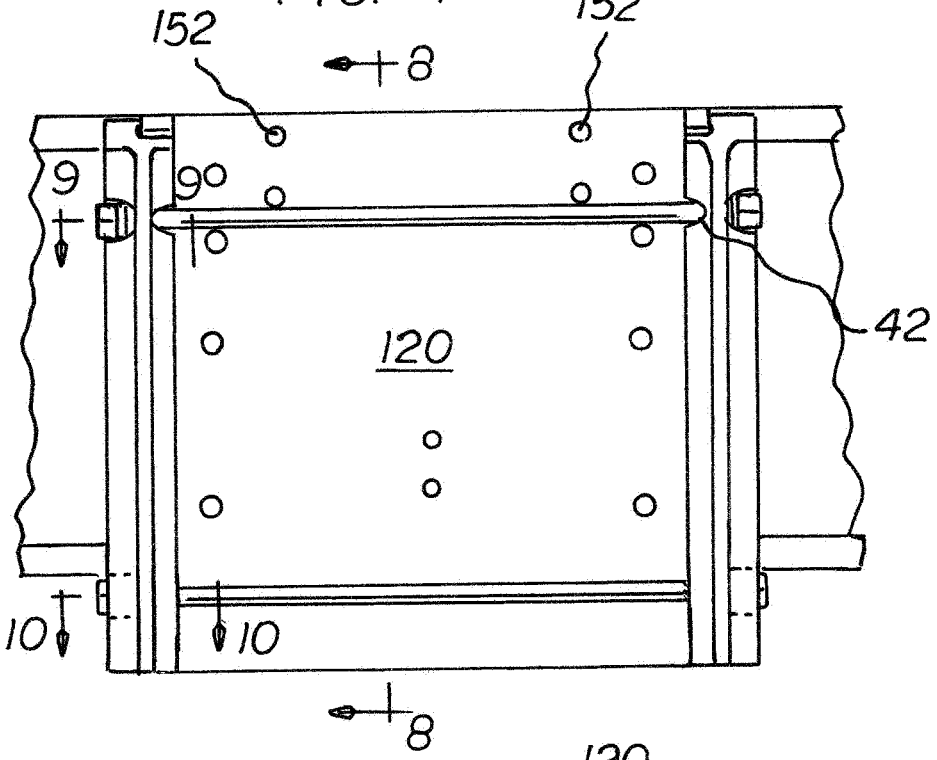
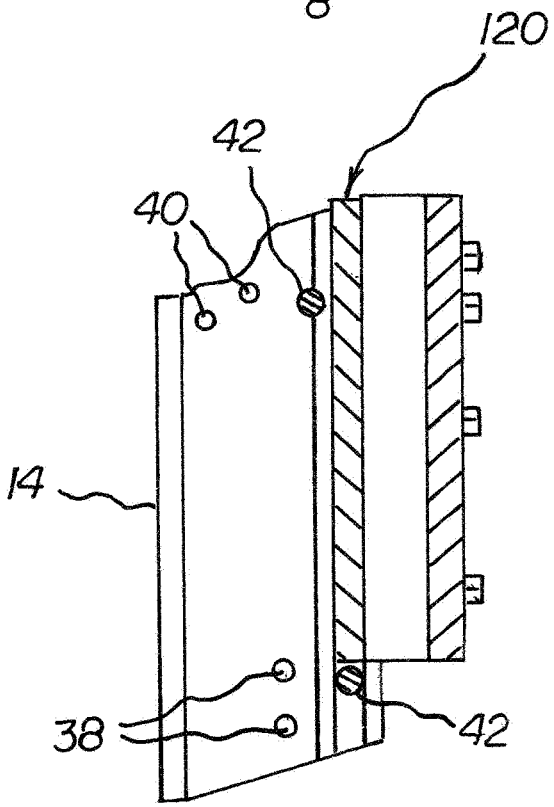
FIG. 8

MULTI-ENGINE, SINGLE MOUNT, HYDRAULIC JACK PLATE WITH ADJUSTABLE TENSIONING RODS

BACKGROUND OF THE INVENTION

Rule 1.78(F)(1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

There are no cross referenced or related applications which are direct to, or related to, the present application.

There is no research of development of this application which is federally sponsored.

FIELD OF THE INVENTION

The present invention relates to a multi-engine hydraulic jack plate and more particularly pertains to a multi-engine jack plate with adjustable tensioning rods.

DESCRIPTION OF THE PRIOR ART

The use of jack plates on boats is known in the prior art. More specifically, jack plates for boats previously devised and utilized for the purpose of raising or lowering an outboard motor, are known to consist basically of familiar, expected, and obvious structural configurations, notwithstanding the number of designs encompassed by the prior art which has been developed for the fulfillment of countless objectives and requirements.

While the prior art devices fulfill their respective, particular objectives and requirements, the prior art does not describe a multi-engine hydraulic jack plate that has adjustable tensioning rods for adjusting the tension, or fit, of a jack plate slide plate.

In this respect, the multi-engine hydraulic jack plate, according to the present invention, substantially departs from the conventional concepts and designs of the prior art, and in doing so provides an apparatus primarily developed for the purpose of describing a jack plate which has adjustable tensioning rods.

Therefore, it can be appreciated that there exists a continuing need for a new and improved multi-engine hydraulic jack plate which has adjustable tensioning rods. In this regard, the present invention substantially fulfills this need.

SUMMARY OF THE INVENTION

In view of the foregoing disadvantages inherent in the known types of jack plates on boats now present in the prior art, the present invention provides an improved multi-engine hydraulic jack plate. As such, the general purpose of the present invention, which will be described subsequently in greater detail, is to provide a new and improved multi-engine hydraulic jack plate which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

In describing aspects of the invention, the word "generally" may be used. The term, "generally" when used to describe a configuration means that the configuration includes those aspects which are within normal manufacturing parameters of acceptance. By way of example, the term "generally round" may be used. This should be interpreted to mean that the configuration may be perfectly round, but may also have a radius which is not exact, but is within the manufacturing parameters. For example, a basketball may be generally round, but not be perfectly round.

By adjacent to a structure is meant that the location is near the identified structure.

The present invention essentially comprises a multi engine, single mount, jack plate, comprising several components, in combination is herein described.

There are a pair of transom mounting brackets. Each of the pair of transom mounting brackets has a transom mounting leg, a rearwardly projecting leg, and a motor slide plate mounting portion. The rearwardly projecting leg is continuous with the transom mounting leg and the motor slide plate mounting portion, forming a continuous structure.

The transom mounting leg has a transom surface and a rearward surface, with a thickness there between. Each of the transom mounting legs has an upper portion with an upper extent and a lower portion with a lower extent. Each of the transom mounting legs has a plurality of transom mounting bolt holes there through.

The pair of rearwardly projecting legs each have a generally flat configuration with an inner surface and an outer surface, with a thickness there between. The rearwardly projecting legs each having a plurality of bolt holes there through, being a pair of lower vertically oriented bolt holes and a pair of generally horizontally oriented bolt holes. The rearwardly projecting legs each have a plurality of tensioning rod holes there through, being an upper tensioning rod hole and a lower tensioning rod hole.

The motor slide plate mounting portion of the each of the pair of transom mounting brackets have a generally C-shaped configuration, with an inner surface having an groove and a generally flat outer surface. The inner surface groove has an associated liner.

The motor slide plate mounting portion has a forward surface and a rearward surface. The rearward surface of each of the C-shaped motor slide plate mounting portions is continuous with one of the rearward projecting legs. Each of the pair of motor slide plate mounting portions has a threaded grease fitting hole located there through with each threaded grease fitting hole having an associated motor slide plate grease fitting.

There are a pair of adjustable tensioning rods, being an upper tensioning rod and a lower tensioning rod. The tensioning rods each have a pair of threaded ends with each threaded tensioning rod ends having associated tensioning rod nut. The tensioning rods each have an external diameter. The tensioning rods are each sized to pass through the upper tensioning rod hole and the lower tensioning rod hole of the rearwardly projecting legs of the pair of transom mounting brackets, thereby adjustably fixing the transom mounting brackets to each other.

There is a lower cross brace having a generally rectilinear configuration with a top surface, a bottom surface, a front surface, a rear surface, and two opposing ends. The lower cross brace opposing ends each have a pair of generally vertically oriented threaded bolt apertures there in. The upper surface of each lower cross brace has a pair generally rectangular recesses therein. The lower cross brace upper surface recesses each have a lower hydraulic cylinder mounting bolt hole there in. Each lower hydraulic cylinder mounting bolt hole runs from the front surface of the lower cross brace, where the bolt hole is smooth, through each recess, toward the rear surface of the lower cross brace, where the bolt hole is threaded. Each lower cylinder mounting bolt hole has an associated lower hydraulic cylinder mounting bolt.

There is a pair of upper cross braces being a rearward upper cross brace and a forward upper cross brace. Each upper cross brace has a generally rectilinear configuration with a top surface, a bottom surface, a front surface, a rear surface, and two opposing ends. The upper cross brace opposing ends of each of the pair of upper cross braces each have a threaded bolt aperture there in. Each of the threaded bolt holes of the pair of upper cross braces has an associated upper cross brace bolt. The upper cross brace bolts pass through the horizontally oriented bolt holes of the rearwardly projecting legs into the upper cross braces, thereby fixing the orientation of the rearwardly projecting legs of the transom mounting brackets in regards to the upper cross braces.

There is a slide plate. The slide plate has a generally rectilinear configuration, with a front surface and a rear surface. The front surface and the rear surface have a thickness there between. The thickness of the slide plate forms a top edge, a bottom edge, and a pair of parallel oriented side edges.

The rear surface side edges of the slide plate have a stepped configuration. The stepped configuration of the rear surface of the side edges of the slide plate is configured to be mated with, and slidably received within, the inner surface groove liner of the motor slide plate mounting portion. The slide plate has a generally central section, with the central section having an upper portion and lower portion. The lower portion of the central section of the slide plate has a pair of travel stop bolt holes there through. The lower portion of the central section of the slide plate has an associated travel stop and a pair of associated travel stop bolts. The slide plate has an upper portion with the slide plate upper portion having two pairs of hydraulic cylinder ram attachment bolt holes there through.

The slide plate upper portion has a pair of associated hydraulic cylinder ram attachment brackets and a plurality of hydraulic cylinder ram attachment bracket bolts. The hydraulic cylinder ram attachment brackets each have a generally C-shaped configuration, with a rearward portion and a pair of forwardly disposed legs. The rearward portion of each of the hydraulic cylinder ram attachment brackets has a pair of bolt holes there through, for fixedly mounting the rearward portion of the hydraulic cylinder ram attachment bracket to the slide plate. The forwardly disposed legs of each of the hydraulic cylinder ram attachment brackets having a hydraulic cylinder ram pin hole there through.

The slide plate has a plurality of rows of motor mounting plate offset coupler bolt holes there through, with the plurality of rows of motor mounting plate offset coupler bolt holes being oriented in a vertical orientation.

There is a pair of hydraulic cylinders with each cylinder having a lower hydraulic cylinder portion and a ram. Each of the lower hydraulic cylinder lower portions has a generally hollow cylindrical configuration with an upper section and a lower section. Each hydraulic cylinder lower section has a rectilinear mounting tab with a bolt hole there through. Each of the pair of lower hydraulic cylinder portion tabs are sized and configured to mate with, and be received by, each of the pair of recesses in the upper surface of the lower cross brace, thereby fixedly mounting each hydraulic cylinder lower portion to the lower cross brace.

Each lower hydraulic cylinder portion has a pair of fluid lines, with one fluid line being located through the upper section of the lower hydraulic cylinder portion and one fluid line being located through the lower section of the lower hydraulic cylinder portion. Each fluid line is operationally coupled to a hydraulic pump.

There is a pair of motor mounting plate offsets. Each motor mounting plate offset has a generally rectilinear configuration. Each of the pair of motor mounting plate offsets has a forward slide plate mounting surface, a rearward motor mounting plate surface, a pair of generally parallel side surfaces, a top surface, and a bottom surface. Each motor mounting plate offset has a plurality of threaded bolt holes on the forward slide plate mounting surface. Each motor mounting plate offset has a plurality of threaded bolt holes on the rearward motor mounting plate surface. Each of the threaded bolt holes of the forward slide plate mounting surface and the threaded bolt holes of the rearward motor mounting plate surface hae an associated coupling bolt. The coupling bolts fixedly couple the forward slide plate mounting surface of the motor mounting plate offsets to the rearward surface of the slide plate through the vertical rows of motor mounting plate offset coupler bolt holes in the slide plate.

Lastly, there is a multi-engine mounting plate. The multi-engine mounting plate has a generally rectilinear configuration with a motor mounting surface, an offset mounting surface, and a thickness there between. The thickness of the multi-engine mounting plate forms a top edge, a bottom edge, and a pair of side edges. The multi-engine mounting plate has a plurality of vertically oriented coupling bolt holes there through. The multi-engine mounting plate is fixedly coupled to the pair of motor mounting plate offsets using the coupler bolts passing through the multi-engine mounting plate and being threaded into the motor mounting plate offsets. The multi-engine mounting plate has a plurality of rectilinear stiffening supports which are fixedly coupled to the offset mounting surface of the multi-engine mounting plate. The plurality of stiffening supports are a pair of upper stiffening supports, a pair of lower stiffening supports, and a pair of vertical stiffening supports. The multi-engine mounting plate has a plurality of motor mounting bolt holes there through for receiving and holding at least one outboard engine on the motor mounting plate motor mounting surface.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-engine, single mount, hydraulic jack plate which has all of the advantages of the prior art jack plates on boats and none of the disadvantages.

It is another object of the present invention to provide a new and improved multi-engine, single mount, hydraulic jack plate which may be easily and efficiently manufactured and marketed.

It is further object of the present invention to provide a new and improved multi-engine, single mount, hydraulic jack plate which is of durable and reliable constructions.

An even further object of the present invention is to provide a new and improved multi-engine, single mount, hydraulic jack plate which is susceptible of a low cost of manufacture with regard to both materials and labor, and which accordingly is then susceptible of low prices of sale to the consuming public, thereby making such multi-engine hydraulic jack plate economically available to the buying public.

Even still another object of the present invention is to provide a multi-engine, single mount, hydraulic jack plate for a jack plate with adjustable tensioning rods.

Lastly, it is an object of the present invention to provide a new and improved multi-engine, single mount, jack plate which has a pair of transom mounting brackets which are movably coupled to a pair of adjustable tensioning rods. There is a lower cross brace and a pair of upper cross braces A slide plate is slidably coupled to the transom mounting brackets. A pair of hydraulic cylinders are coupled to the lower cross brace and each of the hydraulic cylinders is operatively coupled to the slide plate. A pair of motor mounting plate offsets are coupled to the slide plate and to a multi-engine mounting plate.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5B has been added to allow dispersion of the reference numbers of FIG. 5 so as to easily readable.

FIG. 6B has been added to allow dispersion of the reference numbers of FIG. 6 so as to easily readable.

FIG. 7 is a cutaway view from a forward point of view, with the transom mounting brackets being cut away, through the rearwardly projecting leg of the transom mounting brackets adjacent to the motor slide plate mounting portions, with the cross braces and the hydraulic cylinders being removed.

FIG. 8 is a view taken along line 8-8 of FIG. 7.

The same reference numerals refer to the same parts throughout the various Figures.

DESCRIPTION OF THE PREFERRED EMBODIMENT

Figure 1:
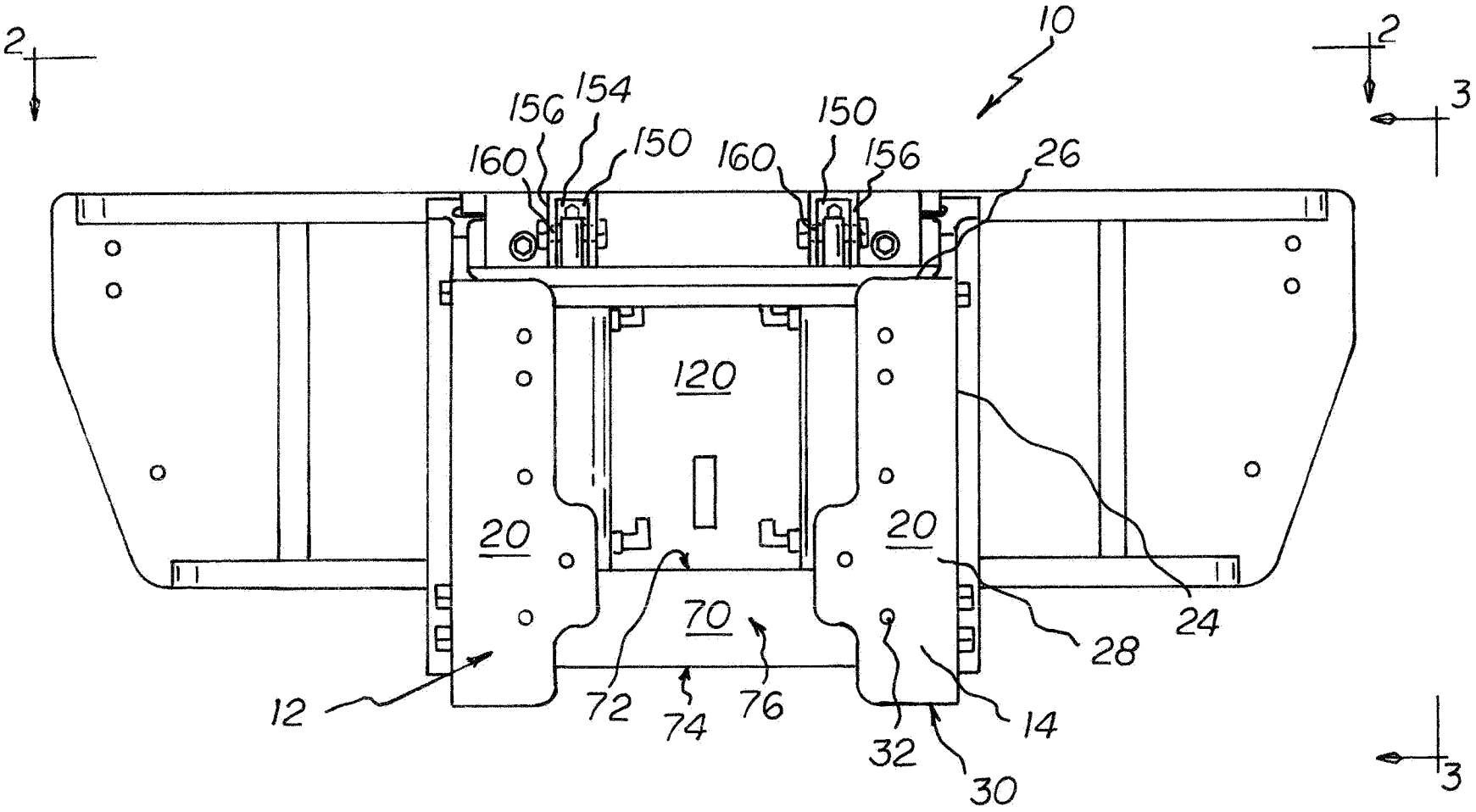
FIG. 1 is forward elevational view of the multi-engine, single mount, hydraulic jack plate.
Figure 3:
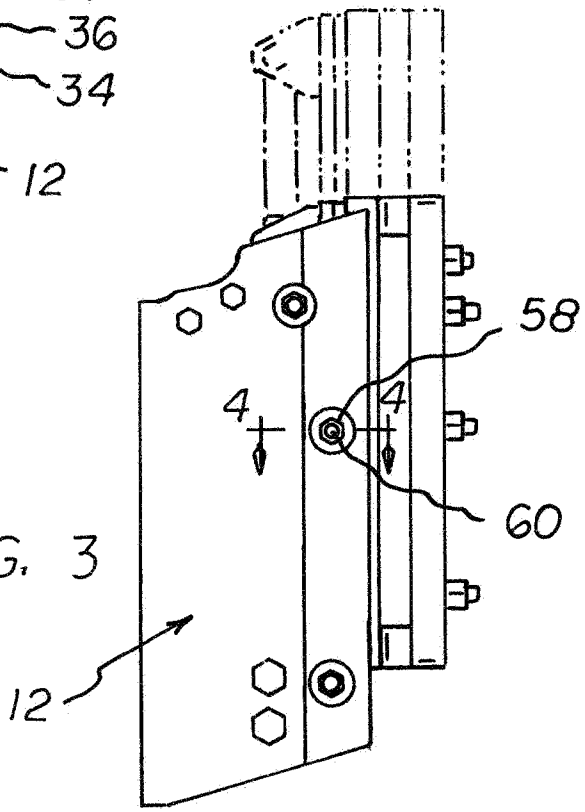
FIG. 3 is a view taken along line 3-3 of FIG. 1.
Figure 2:
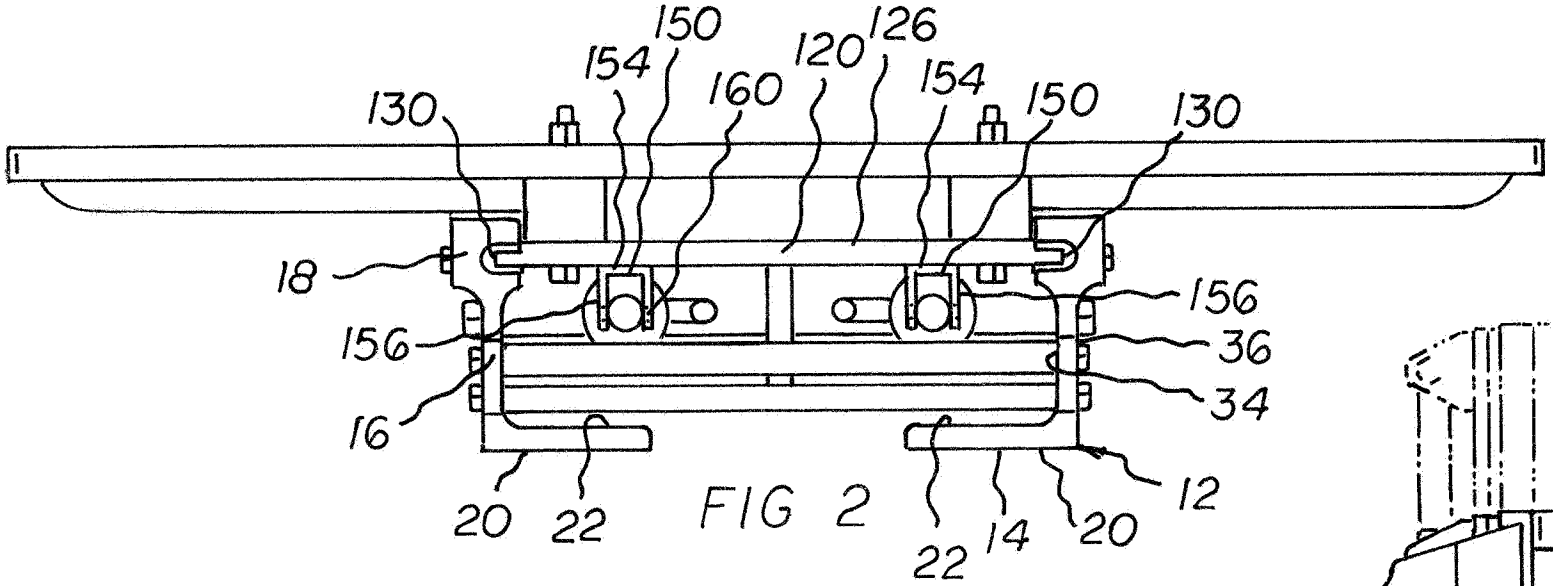
FIG. 2 is a view taken along line 2-2 of FIG. 1.
Figure 4:
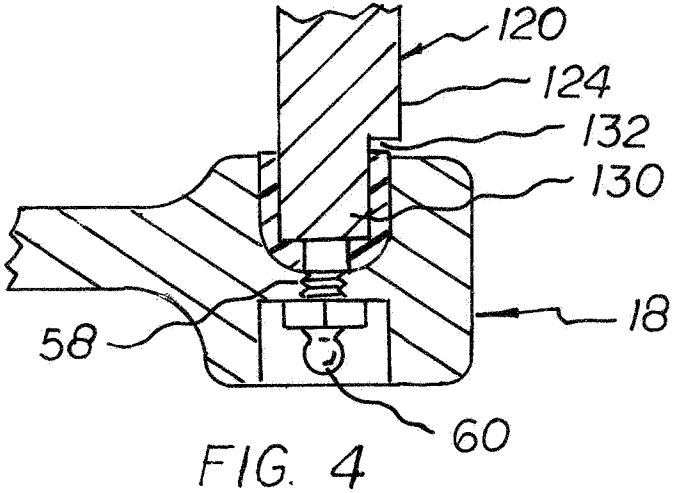
FIG. 4 is a close up, cross sectional view of the motor slide plate mounting portion of the transom mounting bracket, showing the grease fitting, the groove, and the groove liner, along with the slide plate side having the stepped configuration.
Figure 5:
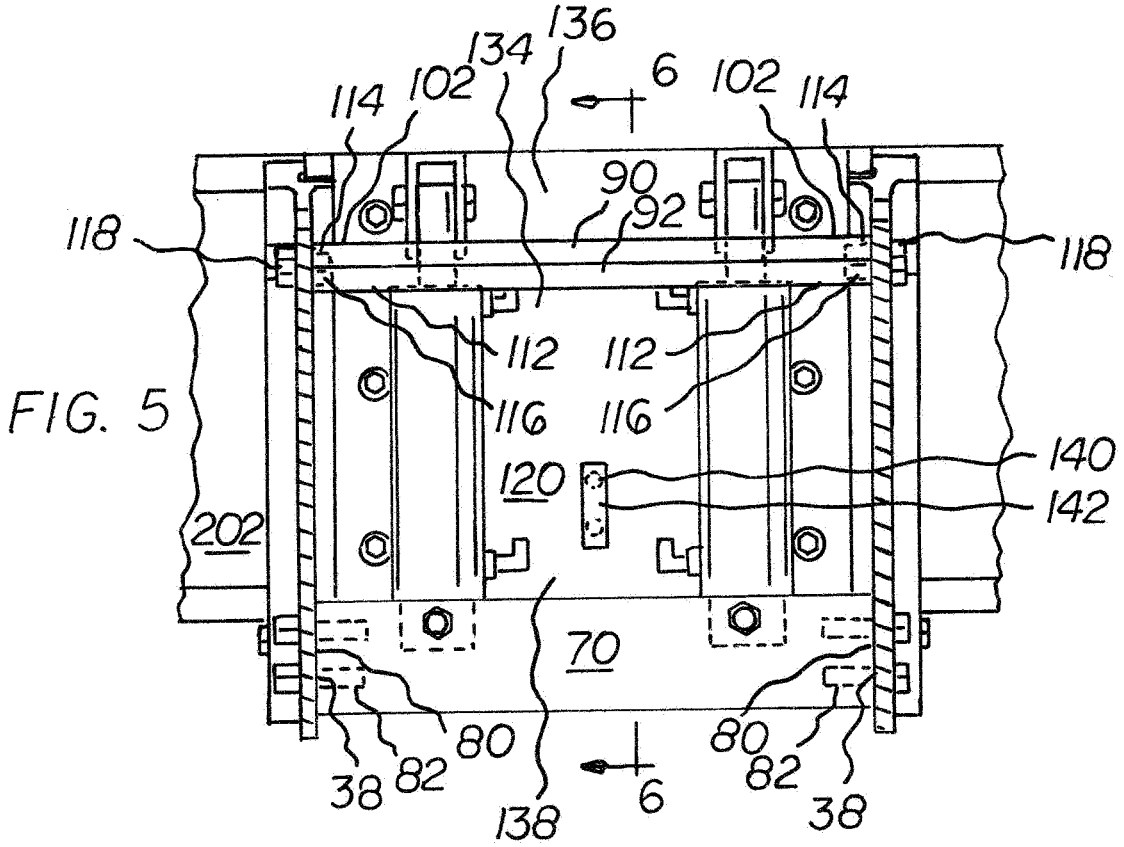
FIG. 5 is cutaway view from a forward point of view, with the transom mounting brackets being cut away, through the rearwardly projecting leg of the transom mounting brackets.
Figure 6:
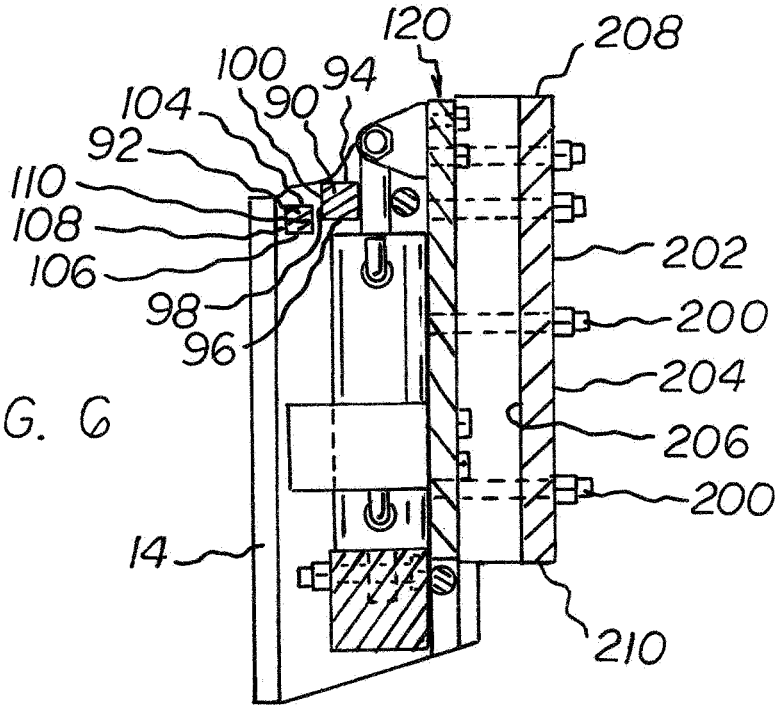
FIG. 6 is a view taken along line 6-6 of FIG. 5.
Figure 5B:
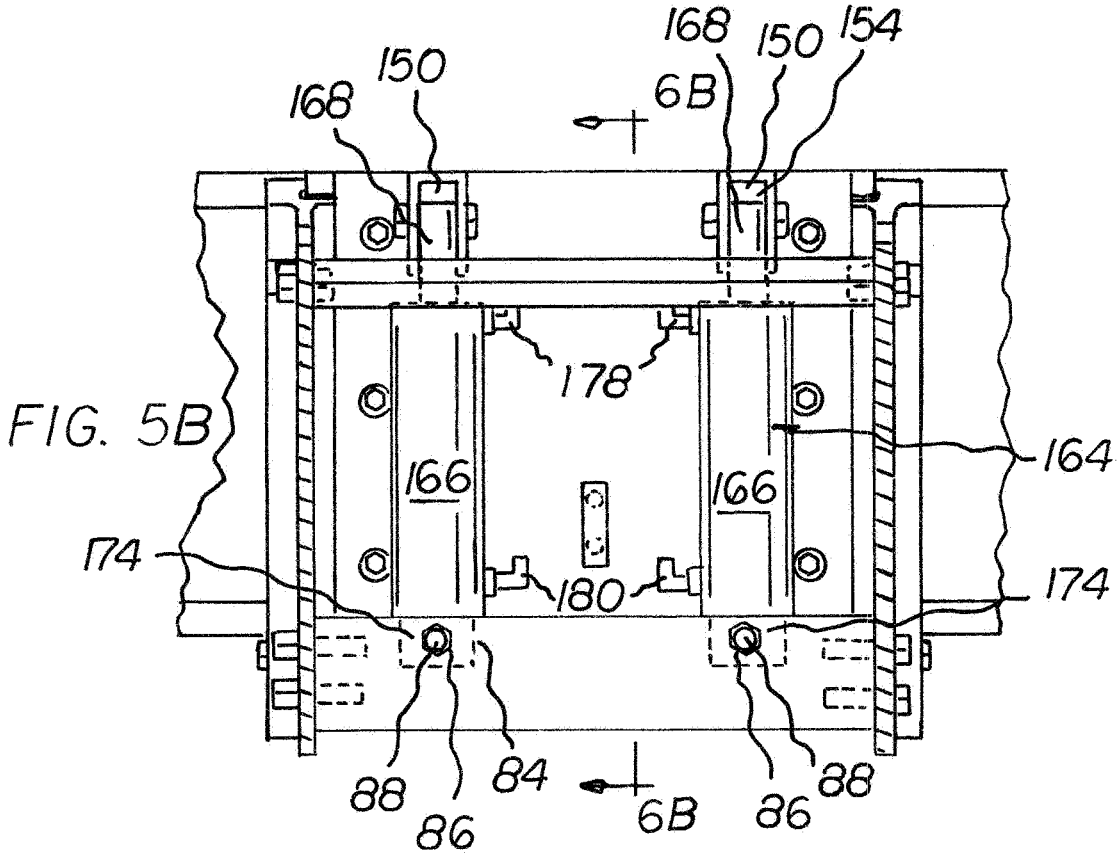
FIG. 5B is the cutaway view of FIG. 5.
Figure 6B:
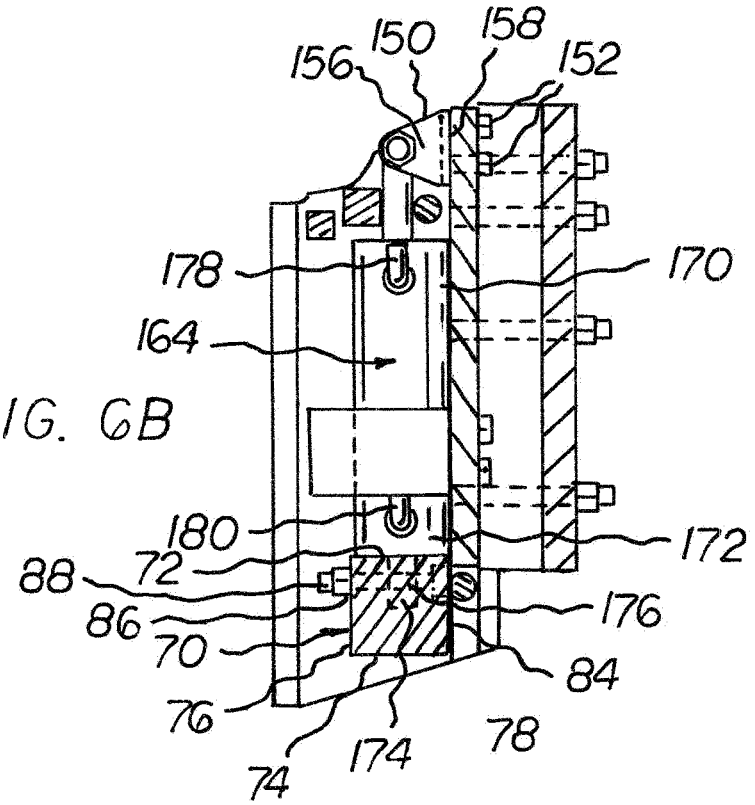
FIG. 6B is the view taken along line 6-6 of FIG. 5.
Figure 9:
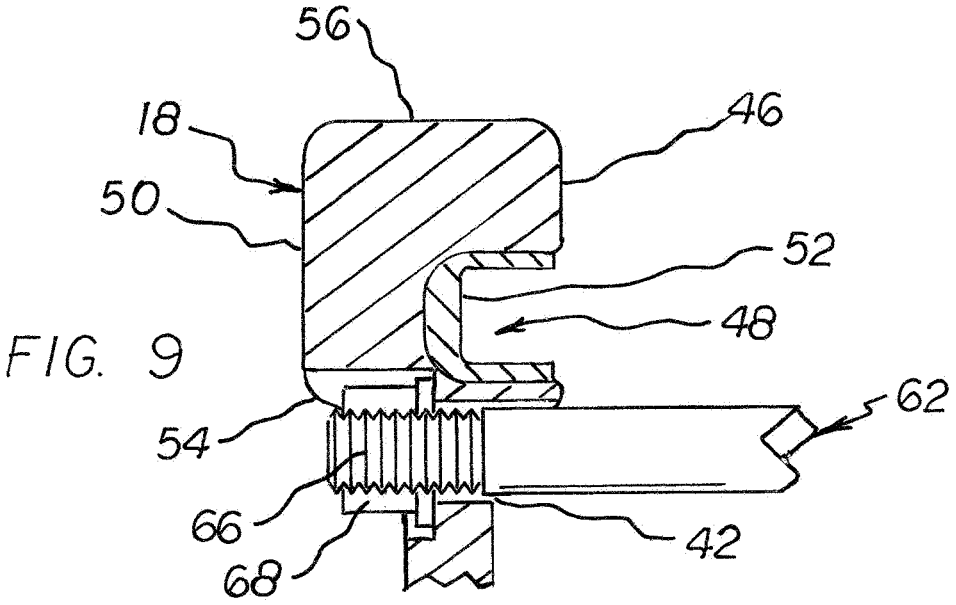
FIG. 9 is a close up view of a cross section of a motor slide plate mounting portion, showing the relationship of the motor slide plate groove and the upper tensioning rod, which lies forward of the groove.
Figure 10:
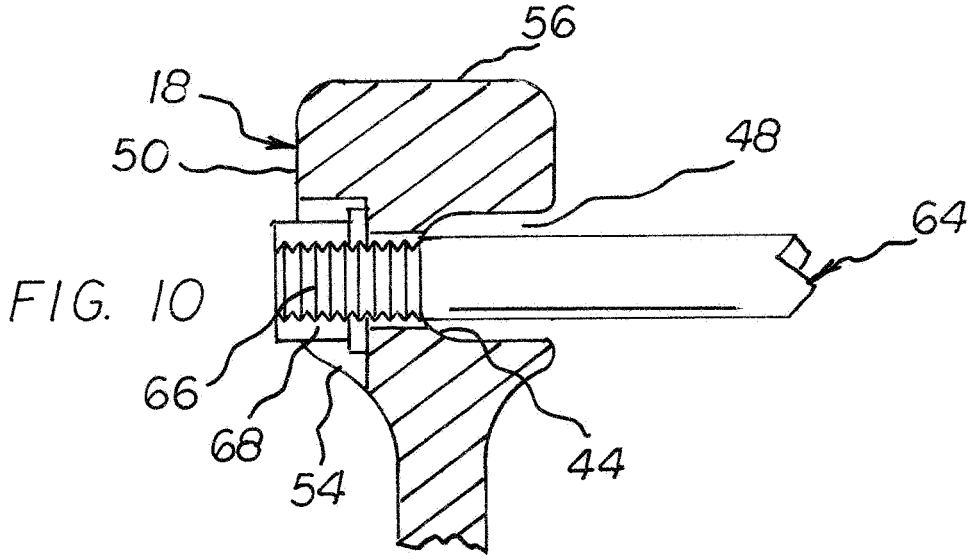
FIG. 10 is a close up view of a cross section of a motor slide plate mounting portion, showing the relationship of the motor slide plate groove and the lower tensioning rod, which lies in line with the groove thereby providing a stop for the downward travel of the slide plate.
Figure 11:
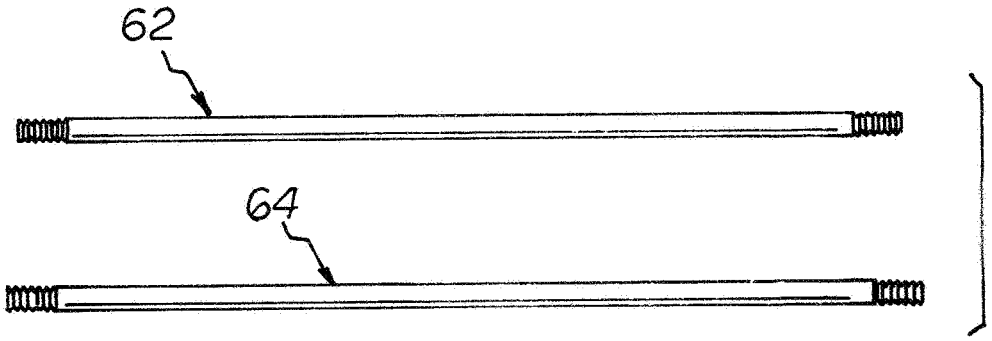
FIG. 11 is a side elevational view of the tensioning rods, being the upper tensioning rod and the lower tensioning rod.
Figure 12:
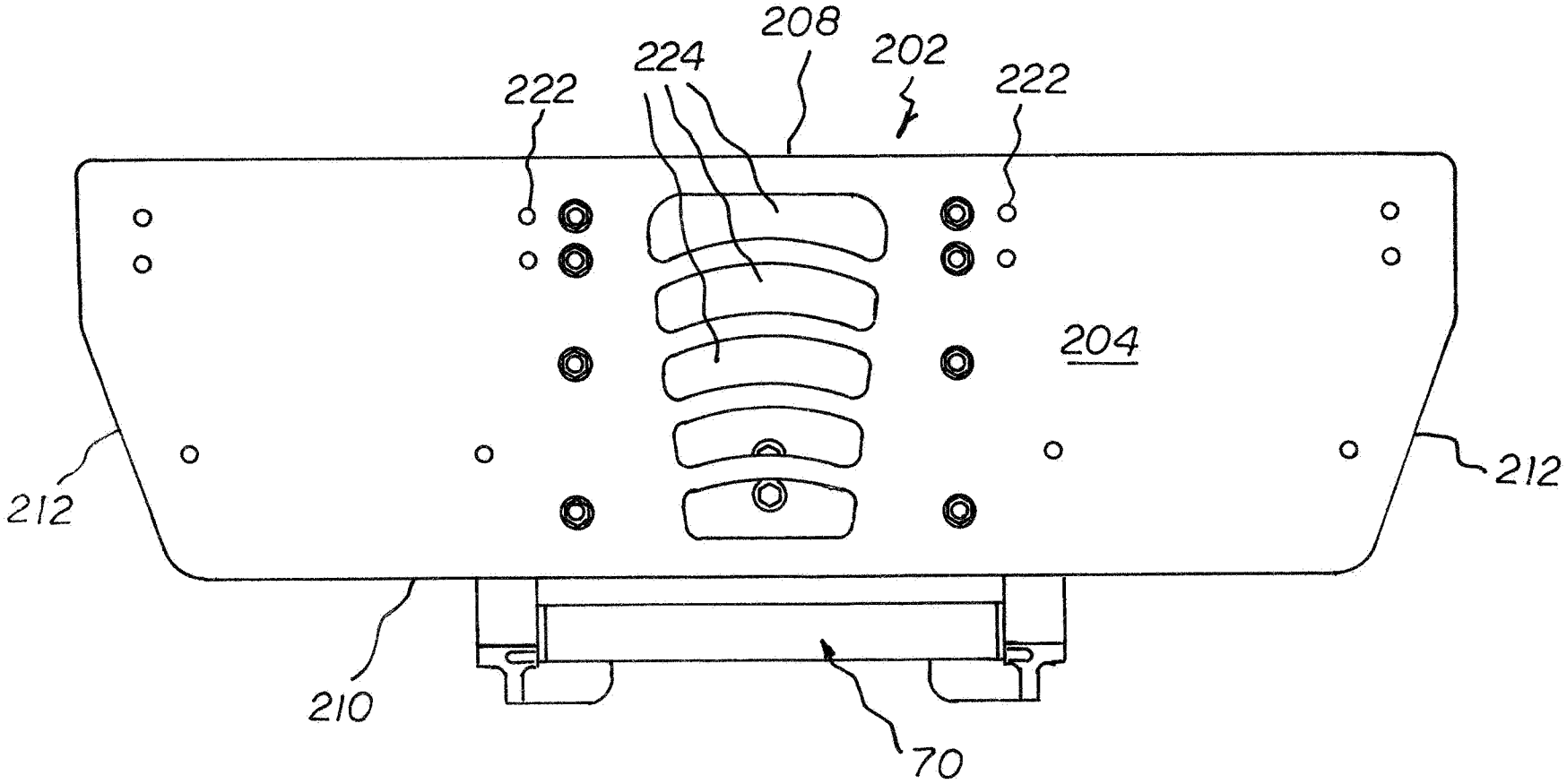
FIG. 12 is a rearward elevational view showing the motor mounting surface of the multi-engine mounting plate.
Figure 13:
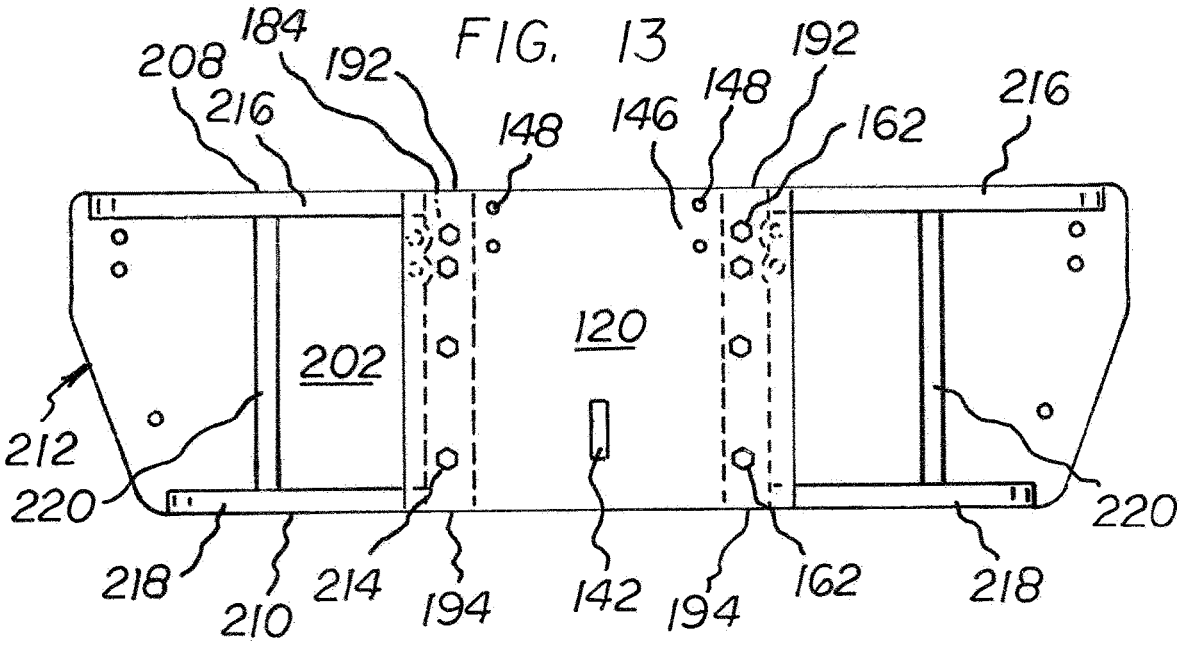
FIG. 13 is a forward elevational view of the multi-engine mounting plate, offset mounting surface, showing the stiffening supports on the offset mounting surface.
Figure 14:
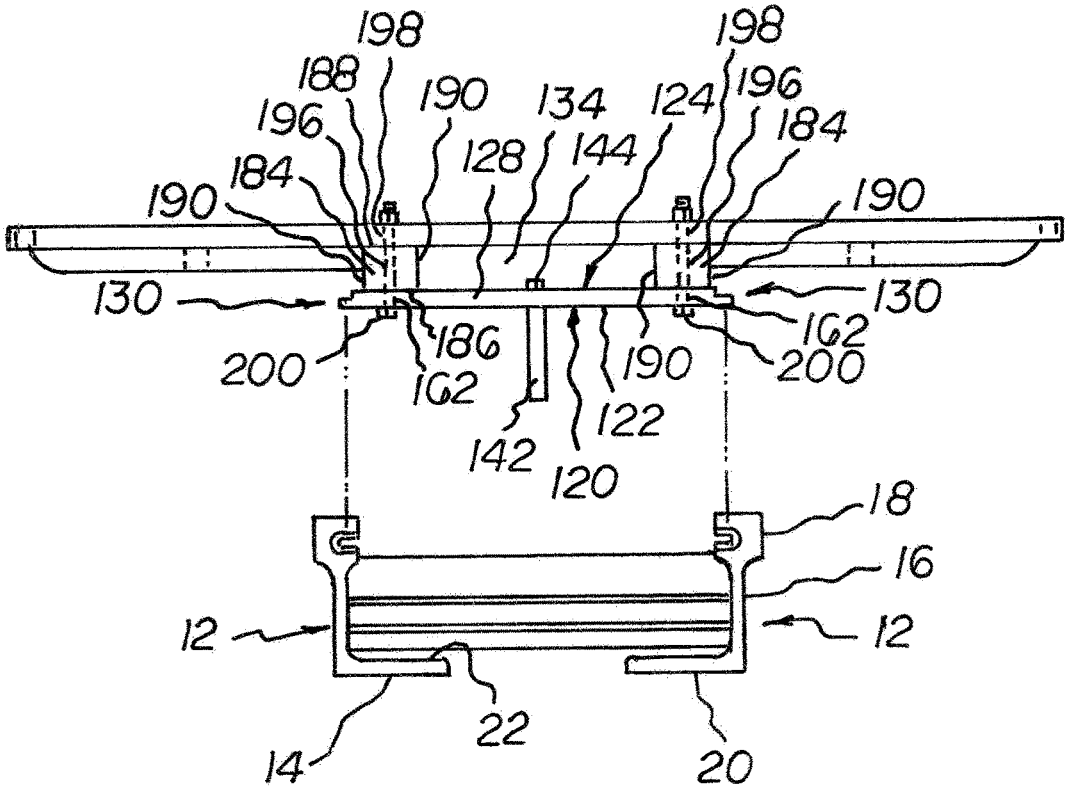
FIG. 14 is a bottom plan exploded view of the transom mounting brackets and the slide plate which is coupled to the multi-engine mounting plate via the offsets. The travel stop is visible protruding from the slide plate.

With reference now to the drawings, and in particular to FIG. 1 thereof, the preferred embodiment of the new and improved multi-engine hydraulic jack plate embodying the principles and concepts of the present invention and generally designated by the reference numeral 10 will be described.

The present invention, the multi-engine hydraulic jack plate 10 is comprised of a plurality of components. Such components in their broadest context include a pair of transom mounting brackets, a slide plate, a pair of offsets and a multi-engine mounting plate. Such components are individually configured and correlated with respect to each other so as to attain the desired objective. A multi engine, single mount, jack plate 10, comprising several components, in combination is herein described.

There are a pair of transom mounting brackets 12. Each of the pair of transom mounting brackets has a transom mounting leg 14, a rearwardly projecting leg 16, and a motor slide plate mounting portion 18. The rearwardly projecting leg 16 is continuous with the transom mounting leg 14 and the motor slide plate mounting portion 18, forming a continuous structure.

The transom mounting leg 14 has a transom surface 20 and a rearward surface 22, with a thickness there between. Each of the transom mounting legs 14 has an upper portion 24 with an upper extent 26 and a lower portion with a lower extent 30. Each of the transom mounting legs 14 has a plurality of transom mounting bolt holes 32 there through.

The pair of rearwardly projecting legs 16 each have a generally flat configuration with an inner surface 34 and an outer surface 36, with a thickness there between. The rearwardly projecting legs 16 each having a plurality of bolt holes there through, being a pair of lower vertically oriented bolt holes 38 and a pair of generally horizontally oriented bolt holes 40.

The rearwardly projecting legs 16 each have a plurality of tensioning rod holes there through, being an upper tensioning rod hole 42 which is forward of the motor slide plate mounting portion 18 and a lower tensioning rod hole 44 which is in line with a motor slide plate mounting portion groove 48.

The motor slide plate mounting portion 18 of the each of the pair of transom mounting brackets 12 have a generally C-shaped configuration, with an inner surface 46 having the motor slide plate mounting portion groove 48 and a generally flat outer surface 50. The inner surface groove has an associated liner 52.

The motor slide plate mounting portion 18 has a forward surface 54 and a rearward surface 56. The rearward surface 56 of each of the C-shaped motor slide plate mounting portions is continuous with one of the rearward projecting legs 16. Each of the pair of motor slide plate mounting portions 18 has a threaded grease fitting hole 58 located there through with each threaded grease fitting hole 58 having an associated motor slide plate grease fitting 60.

There are a pair of adjustable tensioning rods, being an upper tensioning rod 62 and a lower tensioning rod 64. The tensioning rods each have a pair of threaded ends 66 with each threaded tensioning rod ends 66 having associated tensioning rod nut 68. The tensioning rods each have an external diameter. The tensioning rods are each sized to pass through the upper tensioning rod hole 42 and the lower tensioning rod hole 44 of the rearwardly projecting legs 16 of the pair of transom mounting brackets 12, thereby adjustably fixing the transom mounting brackets 12 to each other.

The adjustable tensioning rods 62, 64 are used to adjust the fit of the slide plate 120 in the transom mounting brackets 12 motor slide plate mounting portion 18. The slide plate rear surface 124 stepped configuration fits within the groove 48, and the associated liner 52. With continued use, the liner 52 may wear, allowing for play between the slide plate 120 and the liner 52, which would provide for side to side motion of the slide plate 120, with attendant impact damage to the liner 52. A user may adjust the dimension between the motor slide plate mounting portion 18 and the motor slide plate 120, thereby eliminating the side to side motion and resultant liner 52 damage.

There is a lower cross brace 70 having a generally rectilinear configuration with a top surface 72, a bottom surface 74, a front surface 76, a rear surface 78, and two opposing ends 80. The lower cross brace opposing ends 80 each have a pair of generally vertically oriented threaded bolt apertures 82 there in. The top surface of each lower cross brace 72 has a pair generally rectangular recesses 84 therein. The lower cross brace top surface recesses 84 each have a lower hydraulic cylinder mounting bolt hole 86 there in. Each lower hydraulic cylinder mounting bolt hole 86 runs from the front surface of the lower cross brace 76, where the bolt hole is smooth, through each recess, toward the rear surface of the lower cross brace 78, where the bolt hole is threaded. Each lower cylinder mounting bolt hole 86 has an associated lower hydraulic cylinder mounting bolt 88.

There is a pair of upper cross braces being a rearward upper cross brace 90 and a forward upper cross brace 92. The rearward upper cross brace has a generally rectilinear configuration with a top surface 94, a bottom surface 96, a front surface 98, a rear surface 100, and two opposing ends 102. The forward upper cross brace 92 has a generally rectilinear configuration with a top surface 104, a bottom surface 106, a front surface 108, a rear surface 110, and two opposing ends 112.

The upper cross brace opposing ends of each of the pair of upper cross braces each have a threaded bolt aperture 114, 116 there in. Each of the threaded bolt holes 114, 116 of the pair of upper cross braces has an associated upper cross brace bolt 118. The upper cross brace bolts 118 pass through the horizontally oriented bolt holes 40 of the rearwardly projecting legs 16 into the upper cross braces 90, 92, thereby fixing the orientation of the rearwardly projecting legs 16 of the transom mounting brackets in regards to the upper cross braces 90, 92.

There is a slide plate 120. The slide plate 120 has a generally rectilinear configuration, with a front surface 122 and a rear surface 124. The front surface 122 and the rear surface 124 have a thickness there between. The thickness of the slide plate forms a top edge 126, a bottom edge 128, and a pair of parallel oriented side edges 130.

The slide plate, rear surface 124 side edges 130 have a stepped configuration 132. The stepped configuration 132 of the rear surface 132 of the side edges 130 of the slide plate 120 is configured to be mated with, and slidably received within, the inner surface groove liner 52 of the motor slide plate mounting portion 18. The slide plate 120 has a generally central section 134, with the central section having an upper portion 136 and lower portion 138. The lower portion 138 of the central section 134 of the slide plate has a pair of travel stop bolt holes 140 there through. The lower portion of the central section of the slide plate has an associated travel stop 142 and a pair of associated travel stop bolts 144. The slide plate 120 has an upper portion 146 with the slide plate upper portion having two pairs of hydraulic cylinder ram attachment bolt holes 148 there through.

The slide plate upper portion 146 has a pair of associated hydraulic cylinder ram attachment brackets 150 and a plurality of hydraulic cylinder ram attachment bracket bolts 152. The hydraulic cylinder ram attachment brackets 150 each have a generally C-shaped configuration, with a rearward portion 154 and a pair of forwardly disposed legs 156. The rearward portion 154 of each of the hydraulic cylinder ram attachment brackets 150 has a pair of bolt holes 158 there through, for fixedly mounting the rearward portion 154 of the hydraulic cylinder ram attachment bracket to the slide plate 146. The forwardly disposed legs 156 of each of the hydraulic cylinder ram attachment brackets having a hydraulic cylinder ram pin hole 160 there through.

The slide plate 120 has a plurality of rows of motor mounting plate offset coupler bolt holes 162 there through, with the plurality of rows of motor mounting plate offset coupler bolt holes being oriented in a vertical orientation.

There is a pair of hydraulic cylinders 164 with each cylinder having a lower hydraulic cylinder portion 166 and a ram 168. Each of the lower hydraulic cylinder lower portions 166 has a generally hollow cylindrical configuration with an upper section 170 and a lower section 172. Each hydraulic cylinder lower section has a rectilinear mounting tab 174 with a bolt hole 176 there through. Each of the pair of lower hydraulic cylinder portion tabs are sized and configured to mate with, and be received by, each of the pair of recesses 84 in the upper surface of the lower cross brace, thereby fixedly mounting each hydraulic cylinder lower portion 166 to the lower cross brace 70.

Each lower hydraulic cylinder portion has a pair of fluid lines, with a first fluid line 178 being located through the upper section of the lower hydraulic cylinder portion and a second fluid line 180 being located through the lower section of the lower hydraulic cylinder portion. Each fluid line is operationally coupled to a hydraulic pump which is well known in the art.

There is a pair of motor mounting plate offsets 184. Each motor mounting plate offset has a generally rectilinear configuration. Each of the pair of motor mounting plate offsets has a forward slide plate mounting surface 186, a rearward motor mounting plate surface 188, a pair of generally parallel side surfaces 190, a top surface 192, and a bottom surface 194. Each motor mounting plate offset has a plurality of bolt holes on the forward slide plate mounting surface 196, running through the offset to the rearward mounting plate surface 198. Each of the bolt holes running through the forward slide plate mounting surface to the rearward motor mounting plate surface, has an associated coupling bolt 200. The coupling bolts fixedly couple the forward slide plate mounting surface of the motor mounting plate offsets to the rearward surface of the slide plate through the vertical rows of motor mounting plate offset coupler bolt holes in the slide plate.

Lastly, there is a multi-engine mounting plate 202. The multi-engine mounting plate has a generally rectilinear configuration with a motor mounting surface 204, an offset mounting surface 206, and a thickness there between. The thickness of the multi-engine mounting plate forms a top edge 208, a bottom edge 210, and a pair of side edges 212. The multi-engine mounting plate has a plurality of vertically oriented coupling bolt holes 214 there through. The multi-engine mounting plate is fixedly coupled to the pair of motor mounting plate offsets using the coupler bolts passing through the multi-engine mounting plate and through the motor mounting plate offsets. The multi-engine mounting plate has a plurality of rectilinear stiffening supports which are fixedly coupled to the offset mounting surface of the multi-engine mounting plate. The plurality of stiffening supports are a pair of upper stiffening supports 216, a pair of lower stiffening supports 218, and a pair of vertical stiffening supports 220. The multi-engine mounting plate has a plurality of motor mounting bolt holes 222 there through for receiving and holding at least one outboard engine on the motor mounting plate motor mounting surface. The multi-engine mounting plate 202 has a plurality of lightening cuts 224 there through)

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi engine, single mount, jack plate, comprising, in combination:

a pair of transom mounting brackets, each of the pair of transom mounting brackets having a transom mounting leg and a rearwardly projecting leg and a motor slide plate mounting portion, the rearwardly projecting leg being continuous with the transom mounting leg and the motor slide plate mounting portion, the transom mounting leg having a transom surface and a rearward surface with a thickness there between, each of the transom mounting legs having an upper portion with an upper extent and a lower portion with a lower extent, each of the transom mounting legs having a plurality of transom mounting bolt holes there through, the pair of rearwardly projecting legs each having a generally flat configuration with an inner surface and an outer surface with a thickness there between, the rearwardly projecting legs each having a plurality of bolt holes there through, being a pair of lower vertically oriented bolt holes and a pair of upper generally horizontally oriented bolt holes, the rearwardly projecting legs each having a plurality of tensioning rod holes there through, being an upper tensioning rod hole and a lower tensioning rod hole;

a pair of adjustable tensioning rods, being an upper tensioning rod and a lower tensioning rod, the tensioning rods each having a pair of threaded ends with associated tensioning rod nuts, the tensioning rods having an external diameter, the tensioning rods each being sized to pass through the upper tensioning rod hole and the lower tensioning rod hole of the rearwardly projecting legs of the pair of transom mounting brackets to movably couple the motor slide plate mounting portion of the transom mounting brackets;

a lower cross brace having a generally rectilinear configuration with a top surface and a bottom surface and a front surface and a rear surface and two opposing ends, the lower cross brace opposing ends each having a pair of generally vertically oriented threaded bolt apertures there in;

a pair of upper cross braces being a rearward upper cross brace and a forward upper cross brace, the pair of upper cross braces fixedly coupling each of the rearwardly projecting legs of the pair of transom mounting brackets;

a slide plate having a generally rectilinear configuration having a front surface and a rear surface, the front surface and the rear surface having a thickness there between, the thickness of the slide plate forming a top edge and a bottom edge and a pair of parallel oriented side edges, the slide plate being slidably coupled to the motor slide plate mounting portion of the transom mounting brackets;

a pair of hydraulic cylinders with each cylinder having a lower hydraulic cylinder portion and a ram, each of the lower hydraulic cylinder lower portions having a generally cylindrical configuration with an upper section and a lower section, each lower hydraulic cylinder portion lower sections having a lower extent with the lower extent of each of the hydraulic cylinder portion lower sections having a rectilinear mounting tab with a bolt hole there through, with each hydraulic cylinder portion lower section being operatively coupled to the lower cross brace and each of the hydraulic cylinder rams being coupled to the slide plate;

a pair of motor mounting plate offsets, each of the pair of motor mounting plate offsets having a forward slide plate mounting surface and a rearward motor mounting plate surface and a pair of generally parallel side surfaces and a top surface and a bottom surface with the pair of motor mounting plate offsets being coupled to the slide plate; and a multi-engine mounting plate being coupled to the pair of motor mounting plate offsets.

2. The multi engine, single mount, jack plate, as described in claim 1, with the jack plate further comprising:

the upper surface of each lower cross brace having a pair generally rectangular recesses therein, with the lower cross brace upper surface recesses having a lower hydraulic cylinder mounting bolt hole there in;

the upper cross brace opposing ends of each of the pair of upper cross braces each having a threaded bolt aperture there in;

the slide plate rear surface side edges having a stepped configuration;

the slide plate having an upper portion with the slide plate upper portion having a pair of hydraulic cylinder ram attachment bolt holes there through;

each of the pair of lower hydraulic cylinder portion lower section tabs being sized and configured to mate with and be received by the each of the pair of recesses in the upper surface of the lower cross brace thereby fixedly mounting each hydraulic cylinder lower portion to the lower cross brace; and the multi-engine mounting plate having a generally rectilinear configuration with a motor mounting surface and an offset mounting surface and a thickness there between, with the thickness forming a top edge and a bottom edge and a pair of side edges.

3. The multi engine, single mount, jack plate, as described in claim 2, with the jack plate further comprising:

the motor slide plate mounting portion of the each of the pair of transom mounting brackets having a generally C-shaped configuration;

the lower cross brace bolt holes each running from the front surface of the lower cross brace where the bolt hole is smooth through each recess toward the rear surface of the lower cross brace where the bolt hole is threaded with each lower cross brace bolt hole having an associated lower cross brace bolt;

each upper cross brace having a generally rectilinear configuration with a top surface and a bottom surface and a front surface and a rear surface and two opposing ends;

the stepped configuration of the rear surface of the side edges of the slide plate being configured to be mated with, and slidably received within the inner surface groove liner of the motor slide plate mounting portion;

the slide plate upper portion having a pair of associated hydraulic cylinder ram attachment brackets and a plurality of hydraulic cylinder ram attachment bracket bolts; and each motor mounting plate offset having a generally rectilinear configuration.

4. The multi engine, single mount, jack plate, as described in claim 3, with the jack plate further comprising:

the motor slide plate mounting portion having an inner surface, the inner surface of the motor slide plate mounting portion having an groove and a generally flat outer surface, the motor slide plate mounting portion having a forward surface and a rearward surface;

each of the threaded bolt holes of the pair of upper cross braces having an associated upper cross brace bolt;

the slide plate having a generally central section, with the central section having an upper portion and lower portion;

the hydraulic cylinder ram attachment brackets each having a generally C-shaped configuration with a rearward portion and a pair of forwardly disposed legs;

each lower hydraulic cylinder portion having a pair of fluid lines, with one fluid line being located through the hydraulic cylinder lower portion upper section and one fluid line being located through the hydraulic cylinder lower portion lower section;

each motor mounting plate offset having a plurality of bolt holes there through; and the multi-engine mounting plate having a plurality of vertically oriented coupling bolt holes there through.

5. The multi engine, single mount, jack plate, as described in claim 4, with the jack plate further comprising:

the motor slide plate mounting portion inner surface groove having an associated liner;

the upper cross brace bolts passing through the horizontally oriented bolt holes of the rearwardly projecting legs into the upper cross braces, fixedly coupling the rearwardly projecting legs to the upper cross braces;

the lower portion of the central section of the slide plate having a pair of travel stop bolt holes there through with an associated travel stop and a pair of associated travel stop bolts;

the rearward portion of each of the hydraulic cylinder ram attachment brackets having a pair of bolt holes there through, for fixedly mounting the rearward portion of the hydraulic cylinder ram attachment bracket to the slide plate;

each hydraulic cylinder lower portion fluid line being operationally coupled to a hydraulic pump;

each of the bolt holes of the forward slide plate mounting surface of the offsets and the offsets rearward motor mounting plate surface having an associated coupling bolt; and the multi-engine mounting plate being fixedly coupled to the pair of motor mounting plate offsets using the coupler bolts passing through the multi-engine mounting plate and through the motor mounting plate offsets.

6. The multi engine, single mount, jack plate, as described in claim 5, with the jack plate further comprising:

the rearward surface of each of the C-shaped motor slide plate mounting portions each being continuous with one of the rearward projecting legs;

the upper cross braces fixing the orientation of the rearwardly projecting legs of the transom mounting brackets;

the forwardly disposed legs of each of the hydraulic cylinder ram attachment brackets having a hydraulic cylinder ram pin hole there through, with each hydraulic cylinder attachment bracket having an associated ram pin for coupling the hydraulic cylinder ram to the hydraulic cylinder ram attachment bracket;

the coupling bolts fixedly coupling the forward slide plate mounting surface of the motor mounting plate offsets to the rearward surface of the slide plate through the vertical rows of motor mounting plate offset coupler bolt holes in the slide plate; and the stiffening supports of the multi-engine mounting plate being fixedly coupled to the offset mounting surface of the multi-engine mounting plate.

7. The multi engine, single mount, jack plate, as described in claim 6, with the jack plate further comprising:

each of the pair of mounting slide plate portions outer surface having a threaded grease fitting hole located there through with an associated motor slide plate grease fitting threadedly coupled thereto;

the slide plate having a plurality of rows of motor mounting plate offset coupler bolt holes there through; and the multi-engine mounting plate having a plurality of rectilinear stiffening supports being a pair of upper stiffening supports and a pair of lower stiffening supports and a pair of vertical stiffening supports, the multi-engine mounting plate having a plurality of motor mounting bolt holes there through for receiving and holding at least one outboard engine on the motor mounting plate motor mounting surface.

8. The multi engine, single mount, jack plate, as described in claim 7, with the jack plate further comprising the plurality of rows of motor mounting plate offset coupler bolt holes being oriented in a vertical orientation.

9. A multi engine, single mount, jack plate, comprising, in combination:

a pair of transom mounting brackets, each of the pair of transom mounting brackets having a transom mounting leg and a rearwardly projecting leg and a motor slide plate mounting portion, a lower cross brace coupling the rearwardly projecting legs of the transom mounting brackets;

a pair of upper cross braces fixedly coupling each of the rearwardly projecting legs of the pair of transom mounting brackets;

a slide plate being slidably coupled to the motor slide plate mounting portion of the transom mounting brackets;

a pair of hydraulic cylinders having a lower hydraulic cylinder portion and a ram, lower hydraulic cylinder portion lower section being operatively coupled to the lower cross brace and each of the hydraulic cylinder rams being operatively coupled to the slide plate;

a pair of motor mounting plate offsets being coupled to the slide plate; and a multi-engine mounting plate being coupled to the pair of motor mounting plate offsets, the mounting plate having a plurality of stiffening supports.

10. The multi engine, single mount, jack plate, as described in claim 9, with the jack plate further comprising:

the rearwardly projecting legs each having a plurality of tensioning rod holes there through, being an upper tensioning rod hole and a lower tensioning rod hole; and a pair of adjustable tensioning rods, being an upper tensioning rod and a lower tensioning rod, the tensioning rods movably coupling the motor slide plate mounting portion of the transom mounting brackets.

* * * * *